US008704717B2

(12) United States Patent
Kosnik

(10) Patent No.: US 8,704,717 B2
(45) Date of Patent: Apr. 22, 2014

(54) SATELLITE DISH SNOW SHIELD

(76) Inventor: Richard Gordon Kosnik, Oakhurst, CA (US)

( * ) Notice: Subject to any disclaimer, the term of this patent is extended or adjusted under 35 U.S.C. 154(b) by 263 days.

(21) Appl. No.: 13/088,379

(22) Filed: Apr. 17, 2011

(65) Prior Publication Data

US 2012/0262349 A1 Oct. 18, 2012

(51) Int. Cl.
*H01Q 1/42* (2006.01)

(52) U.S. Cl.
USPC ..... 343/704; 343/872

(58) Field of Classification Search
USPC ..... 343/872, 704
See application file for complete search history.

(56) References Cited

U.S. PATENT DOCUMENTS

| | | | | |
|---|---|---|---|---|
| 5,877,730 | A * | 3/1999 | Foster | 343/840 |
| D426,234 | S * | 6/2000 | Cunningham et al. | D14/230 |
| 2006/0092089 | A1 * | 5/2006 | Courtney | 343/872 |

* cited by examiner

*Primary Examiner* — Karl D Frech

(57) ABSTRACT

The satellite dish snow shield is an add-on device that is designed to fit most commercially produced satellite dish sizes and shapes, and self-aligns as it is installed. This snow shield is a solid curved hood-shaped barrier that attaches at the top of the satellite dish and extends out at a relatively perpendicular angle from the face of the satellite dish. In this way, the snow shield prevents snow build-up and signal disruption by catching and diverting failing snow before it reaches the face of the satellite dish. This satellite snow shield does not, in any way, shroud the actual face of the satellite dish (antenna). Snow falling on these shroud type devices can themselves collect snow in a way that will eventually cause signal loss. However, no matter how much snow accumulates on the snow shield, my device continues to allow for a clear and unobstructed satellite signal to reach the dish (antenna). Due to the unique tab and clip system, my snow shield is a true snap-on device that requires no screws, nuts, bolts or tools of any kind to install and secure into place.

7 Claims, 3 Drawing Sheets

SATELLITE DISH SNOW SHIELD

BACKGROUND OF THE INVENTION

Snow build-up is a real problem for those who have satellite dish TV systems. Even a light snow build-up on the face of the satellite dish (antenna) can cause TV signal loss. My invention is an add-on accessory for satellite dishes designed for the solution for this problem. My satellite dish snow shield works in an entirely different way than satellite dish covers that shroud the entire face of the satellite dish. The satellite dish snow shield is comprised of a solid curved hood that attaches at the top of the satellite dish and extends out at a relatively perpendicular angle from the face of the satellite dish. The snow shield allows for a continual clear and unobstructed satellite signal, by catching and diverting falling snow before it reaches the face of the satellite dish

DESCRIPTION

Figure 1:
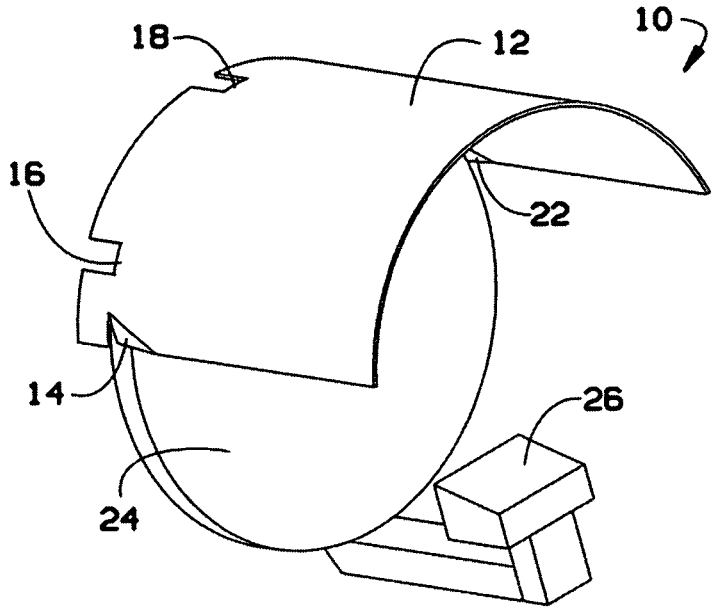
FIG. 1 shows the snow shield of the current invention installed on a satellite dish.
Figure 2:
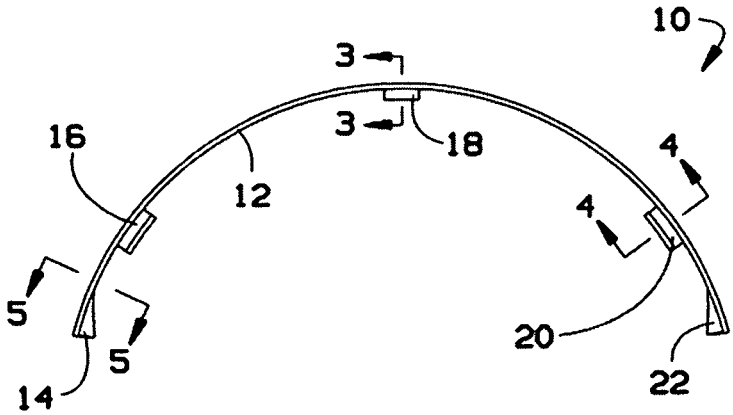
FIG. 2 shows an end view of the snow shield of the current invention.
Figure 3:
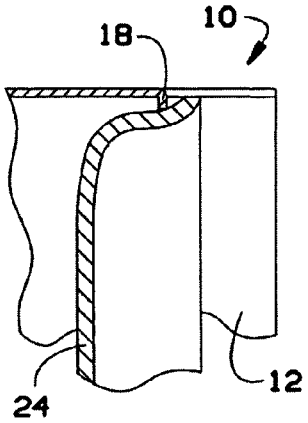
FIG. 3 shows the stabilizing tab of the current invention.
Figure 4:
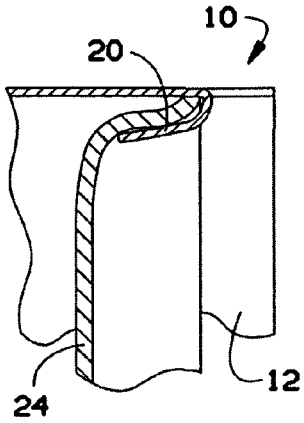
FIG. 4 shows the retaining clip of the current invention.
Figure 5:
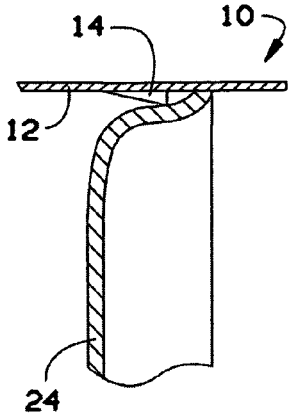
FIG. 5 shows the locking tab of the current invention.
Figure 6:
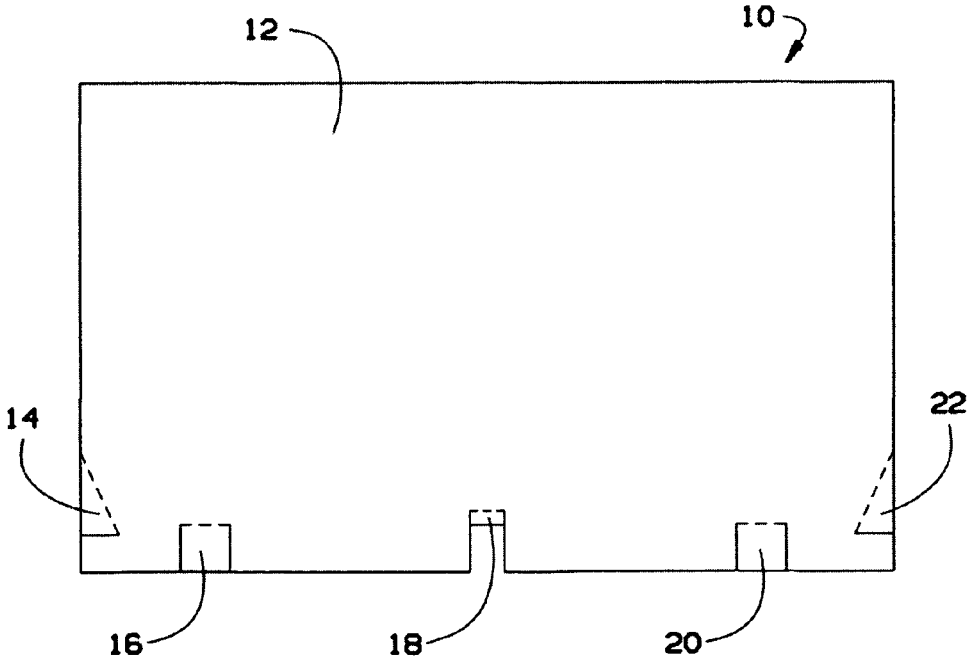
FIG. 6 shows a planar view of the current invention.
Figure 7:
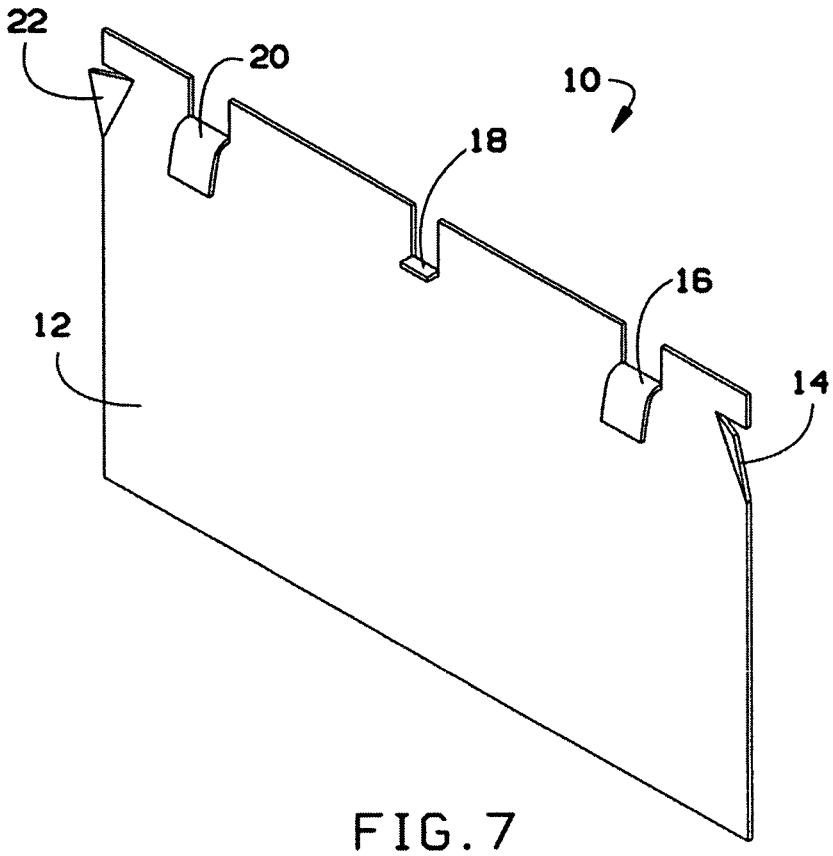
FIG. 7 shows a planar perspective view of the current invention.

This device is comprised of the following elements:

This snow shield (12) is a solid hood-shaped add-on physical barrier that attaches to existing commercially produced satellite dishes (24) in order to prevent signal loss due to snow build-up between the dish (24) and receiver (26).

This snow shield (12) incorporates a system of uniquely designed and positioned stabilizing tabs (18), retaining clips (16, 20), and locking tabs (14, 22) that allows for the snow shield (12) to be a true snap-on device, that as it is attached, adapts to different satellite dish (24) sizes and shapes.

The unique stabilizing tab (18), retaining clips (16,20), and locking tabs (14,22), make my snow shield (12) a true snap-on device that requires no screws, nuts, bolts, or tools to install.

The stabilizing tabs (18), retaining clips (16, 20), and locking tabs (14, 22) allow for a device that, as it is installed, self-aligns at precise angles so that it does not interfere with satellite signals. This tab and clip system is essential for the successful installation, positioning, and function of the snow shield (12).

The specifically sized and shaped ridged hood, and the uniquely designed tabs and clips, and they're placement, are essential for this self-aligning snap-on snow shield. Some larger, elliptical shaped satellite dishes may require additional retaining clips, which would make these additional clips also necessary for the successful attachment and alignment of the snow shield.

Sheet metal fabrication has proven to be a very successful way to produce a durable and completely maintenance-free device. However, the hood could also be made of some other ridged material, and the attachment could be accomplished in some other, more difficult and complicated way, such as a combination of screws and/or clamps.

My snow shield catches and diverts falling snow before it can reach the dish. Satellite dish covers that shroud the entire face of the dish are prone to snow build-up themselves, which ultimately causes signal loss. In contrast, no matter how much snow accumulates on my snow shield, a clear and unobstructed satellite signal is maintained.

In its most basic design, my snow shield requires only one piece of sheet metal. The sheet metal is curved in order to mimic the specific shape of the satellite dish. Then, small specific and precise cuts are made on the back edge of the sheet metal. Utilizing these precision cuts, the sheet metal is specifically bent and shaped in order to provide the stabilizing tab, retaining clips, and locking tabs. The stabilizing tab, retaining clips, and locking tabs could also be added as separate pieces of metal through spot-welding them to the curved sheet metal.

The snow shield is uniquely designed to attach to different satellite dish shapes and sizes.

What is claimed is:

1. A satellite dish snow shield comprising a solid curved hood-shaped shield device, a system of uniquely designed and positioned stabilizing tabs, retaining clips, and locking tabs that attach the shield device at the top of the satellite dish, the shield device extending out from the front surface of a satellite dish somewhat more vertically than 90 degrees perpendicular and flaring vertically upward and horizontally outward to allow for multiple satellite signals from different angles, the shield device operative to catch and divert falling snow before it accumulates on the front surface of the satellite dish.

2. The satellite dish snow shield of claim 1, further comprising angled stabilizing tabs, retaining clips and locking tabs, the tabs and clips positioned to self-align the shield device at the correct vertical increase from perpendicular for differently sized and shaped satellite dishes as it extends out from the front surface of the satellite dish.

3. The satellite dish snow shield of claim 1, further comprising integral tabs and clips which snap onto an outer rim of differently sized and shaped satellite dishes and securing the snow shield to the satellite dish.

4. A method of installing a satellite dish snow shield device comprising, orienting the shield device in relation to a satellite dish in a manner that the shield device does not prevent the satellite dish from receiving signals from multiple satellites from different angles.

5. The method of installing a satellite dish snow shield device of claim 4, further comprising the bending the shield device to match the curvature of the outer rim of differently sized and shaped satellite dishes.

6. The method of installing a satellite dish snow shield device of claim 4, further comprising positioning the shield device in an orientation to prevent falling snow from accumulating on a front surface of differently sized and shaped satellite dishes.

7. The method of installing a satellite dish snow shield device of claim 4, further comprising providing on the shield device, angled stabilizing tabs, retaining clips and locking tabs; the tabs and clips are attached to the outer rim of the satellite dish in a manner which automatically orients the shield device at the correct vertical increase from perpendicular and creating the flaring vertically upward and horizontally outward to allow for multiple satellite signals from different angles.

* * * * *